US009787018B2

(12) United States Patent
Chonan

(10) Patent No.: US 9,787,018 B2
(45) Date of Patent: Oct. 10, 2017

(54) WATERTIGHT CONNECTOR

(71) Applicant: Sumitomo Wiring Systems, Ltd., Yokkaichi, Mie (JP)

(72) Inventor: Takahisa Chonan, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/276,855

(22) Filed: Sep. 27, 2016

(65) Prior Publication Data

US 2017/0104293 A1 Apr. 13, 2017

(30) Foreign Application Priority Data

Oct. 8, 2015 (JP) ..... 2015-199980

(51) Int. Cl.
*H01R 13/40* (2006.01)
*H01R 13/52* (2006.01)

(52) U.S. Cl.
CPC ..... *H01R 13/5202* (2013.01); *H01R 13/5208* (2013.01)

(58) Field of Classification Search
CPC H01R 17/12; H01R 13/5213; H01R 13/5216; H01R 13/5221
USPC ..... 439/587, 588, 936, 352, 274, 275
See application file for complete search history.

(56) References Cited

U.S. PATENT DOCUMENTS 4,998,896 A * 3/1991 Lundergan ..... H01R 13/443 439/274
2006/0094275 A1 5/2006 Fukatsu et al.

FOREIGN PATENT DOCUMENTS

JP 2006-127992 5/2006

* cited by examiner

*Primary Examiner* — Phuongchi T Nguyen
(74) *Attorney, Agent, or Firm* — Gerald E. Hespos; Michael J. Porco; Matthew T. Hespos

(57) ABSTRACT

A one-piece rubber plug (50) is arranged on a rear end part of a housing (70) and a rear holder (30) to be locked to the housing (70) is arranged behind the rubber plug (50). A receptacle (10) is fit externally to the housing (70) from front and an opening end part of the receptacle (10) is held in close contact with lips (55) of the rubber plug (50). The receptacle (10) includes short side walls (15) that face each other in a first direction and long side walls (14) that face each other in a second direction. Receptacle-side escaping portions (19) retracted more in a front-back direction than inner peripheries of opening end parts of the long side walls (14) are provided on inner peripheries of opening end parts of the short side walls (15).

8 Claims, 8 Drawing Sheets

WATERTIGHT CONNECTOR

BACKGROUND

Field of the Invention

The present invention relates to a watertight connector.

A watertight connector disclosed in Japanese Unexamined Patent Publication No. 2006-127992 includes a housing for accommodating terminal fittings, a one-piece rubber plug arranged on a rear end part of the housing and including seal holes through which wires connected to the terminal fittings are to be inserted in a liquid-tight manner, a rubber plug holder (rear holder) arranged behind the one-piece rubber plug for sandwiching the one-piece rubber plug between the housing and the rubber plug holder by being locked to the housing, and a receptacle-like cap to be externally fitted to the housing from front. A busbar body formed by integrating a busbar with a holding body is mounted into a front end part of the housing. When the busbar body is mounted into the housing, the terminal fittings are connected to the busbar and short-circuited in a predetermined pattern. After the busbar body is mounted, the cap is fitted to the housing and an opening end part of the cap is held in close contact with a lip portion formed on the outer periphery of the one-piece rubber plug. In this way, the intrusion of water into the cap through a clearance between the inner periphery of the cap and the outer periphery of the one-piece rubber plug is prevented. The cap includes arcuate short side walls facing each other in a lateral direction and serving as short sides extending in a vertical direction and straight long side walls facing each other in the vertical direction and serving as long sides extending in the lateral direction (no term is given in Japanese Unexamined Patent Publication No. 2006-127992) and has a flat opening shape long in the lateral direction as a whole.

In the process of mounting the cap on the housing, the opening end part of the cap moves onto lips of the one-piece rubber plug and slides. Thus, the lips may be dragged by the cap to tilt. If the last lip largely tilts, this lip may be caught between the rubber plug holder and the cap and it may not be possible to ensure predetermined sealability. In this case, if wires having a large outer diameter are inserted into the seal holes and the one-piece rubber plug bulges outwardly, a large resilient reaction force is applied to the opening end part of the cap from the lip side of the one-piece rubber plug. Although the long side walls can suppress a contact pressure with the lip side by being deflected and deformed, the short side walls are difficult to deflect and deform and, hence, it is difficult to make a contact pressure with the lip side smaller. Thus, the lips tilt more on the short side walls than on the long side walls and the one-piece rubber plug is easily caught.

The present invention was completed based on the above situation and aims to provide a watertight connector capable of ensuring sealability by avoiding the catching of a one-piece rubber plug.

SUMMARY

The invention is directed to a watertight connector with a housing into which terminal fittings are to be inserted. A one-piece rubber plug is arranged on a rear end part of the housing and includes seal holes through which wires connected to the terminal fittings are to be inserted in a liquid-tight manner. A lip is formed on an outer periphery of the one-piece rubber plug. A rear holder is arranged behind the one-piece rubber plug and is configured to hold the one-piece rubber plug between the housing and the rear holder by being locked to the housing. A receptacle is to be fit externally to the housing from the front and has an opening end part to be held in close contact with the lip of the one-piece rubber plug. The receptacle includes opposed short side walls extending in a first direction and opposed long side walls facing extending in a second direction that intersects the first direction. Receptacle-side escaping portions are provided on inner peripheries of opening end parts of the short side walls and are retracted more in a front-back direction than inner peripheries of opening end parts of the long side walls.

If a resilient reaction force of the one-piece rubber plug acts on the opening end part of the receptacle, the long side walls can be deflected and deformed to reduce a contact pressure with the lip, whereas the short side walls can reduce the contact pressure with the lip by the receptacle-side escaping portions. Thus, the tilt of the lip can be suppressed to be small and a situation where the lip is caught between the receptacle and the rear holder can be avoided. As a result, predetermined sealing by the one-piece rubber plug can be ensured. Further, it is not necessary for the long side walls to have large retracted parts like the receptacle-side escaping portions. Thus, the receptacle need not be enlarged.

The receptacle-side escaping portions are arranged at positions distant from the lip when the receptacle is fit externally to the housing. According to this configuration, parts of the opening end part of the receptacle other than the receptacle-side escaping portions are held in close contact with the lip with the receptacle fit externally on the housing. Thus, predetermined sealing can be ensured by increasing a close contact force between the receptacle and the lip.

DETAILED DESCRIPTION

Hereinafter, an embodiment is described with reference to FIGS. 1 to 8.

Figure 1:
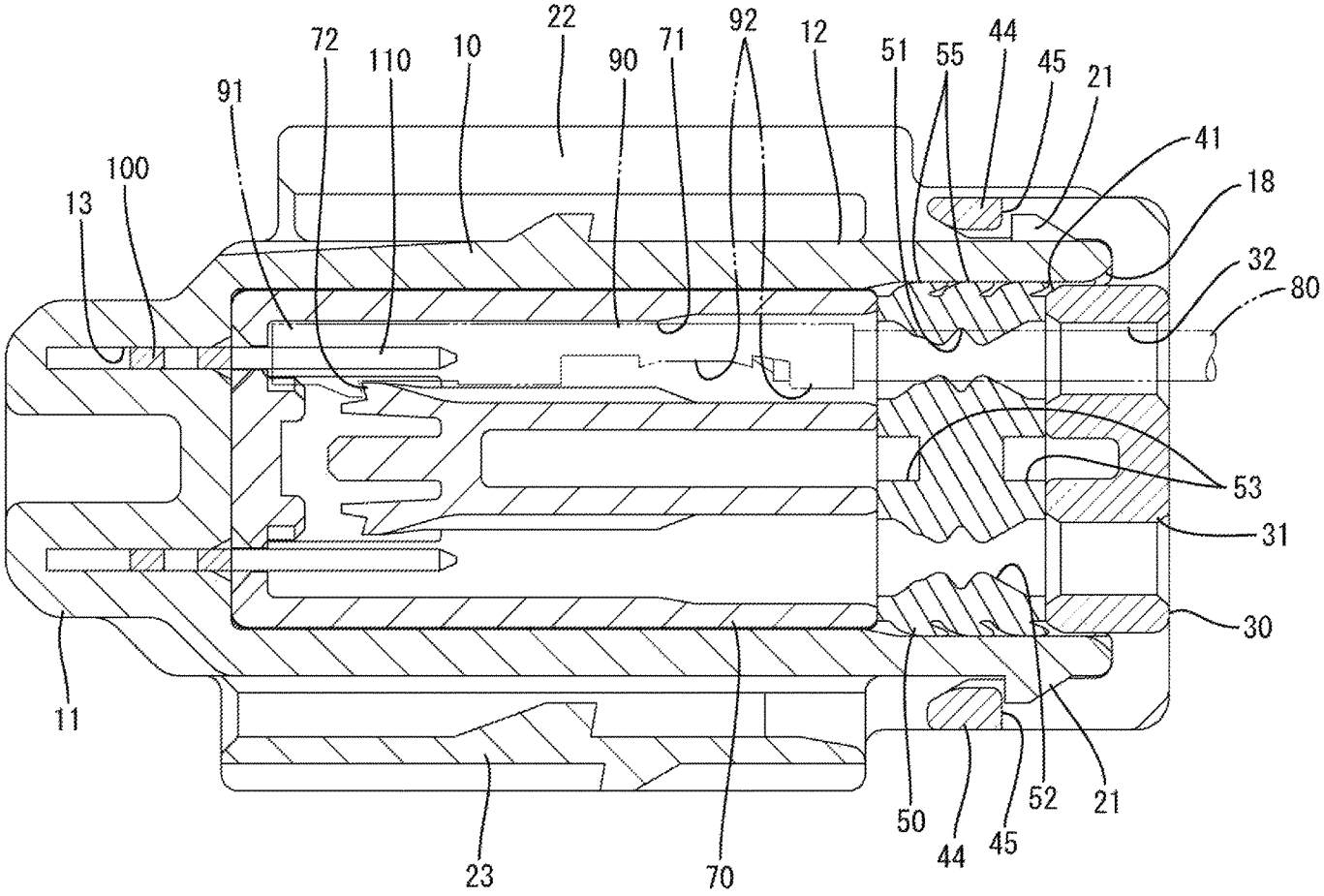
FIG. 1 is a section of a watertight connector according to an embodiment of the present invention.

A watertight connector according to the following embodiment includes, as shown in FIG. 1, a plurality of terminal fittings 90 made of electrically conductive metal, a housing 70 made of synthetic resin and capable of accommodating each terminal fitting 90, a one-piece rubber plug 50 made of rubber and arranged on a rear end part of the housing 70, a rear holder 30 made of synthetic resin and arranged behind the one-piece rubber plug 50 to be locked to the housing 70, a plurality of busbars 100 made of electrically conductive metal and a receptacle 10 made of synthetic resin and to be externally fitted to the housing 70 with each busbar 100 mounted therein. When the receptacle 10 is externally fitted to the housing 70, the respective terminal fittings 90 are short-circuited to the corresponding busbars 100 in a predetermined short circuit pattern. Note that left and right sides of FIG. 1 are referred to as front and rear sides concerning a front-back direction.

The terminal fitting 90 is long and narrow in the front-back direction and includes a tubular connecting portion 91 and a barrel portion 92 in the form of an open barrel arranged behind the connecting portion 91. The barrel portion 92 is electrically and mechanically connected to an end part of a wire 80. A later-described tab piece 110 of the busbar 100 is inserted into the connecting portion 91 to be electrically connected.

The housing 70 is in the form of a flat block short in a vertical direction (first direction) and long in a lateral direction (second direction) when viewed from front and internally includes a plurality of cavities 71 into which the terminal fittings 90 are insertable. The respective cavities 71 are arranged in two upper and lower stages and locking lances 72 projecting forward are provided on a partition wall part partitioning between the upper and lower cavities 71. The terminal fittings 90 are retained and held in the cavities 71 by the connecting portions 91 being locked by the locking lances 72.

Figure 5:
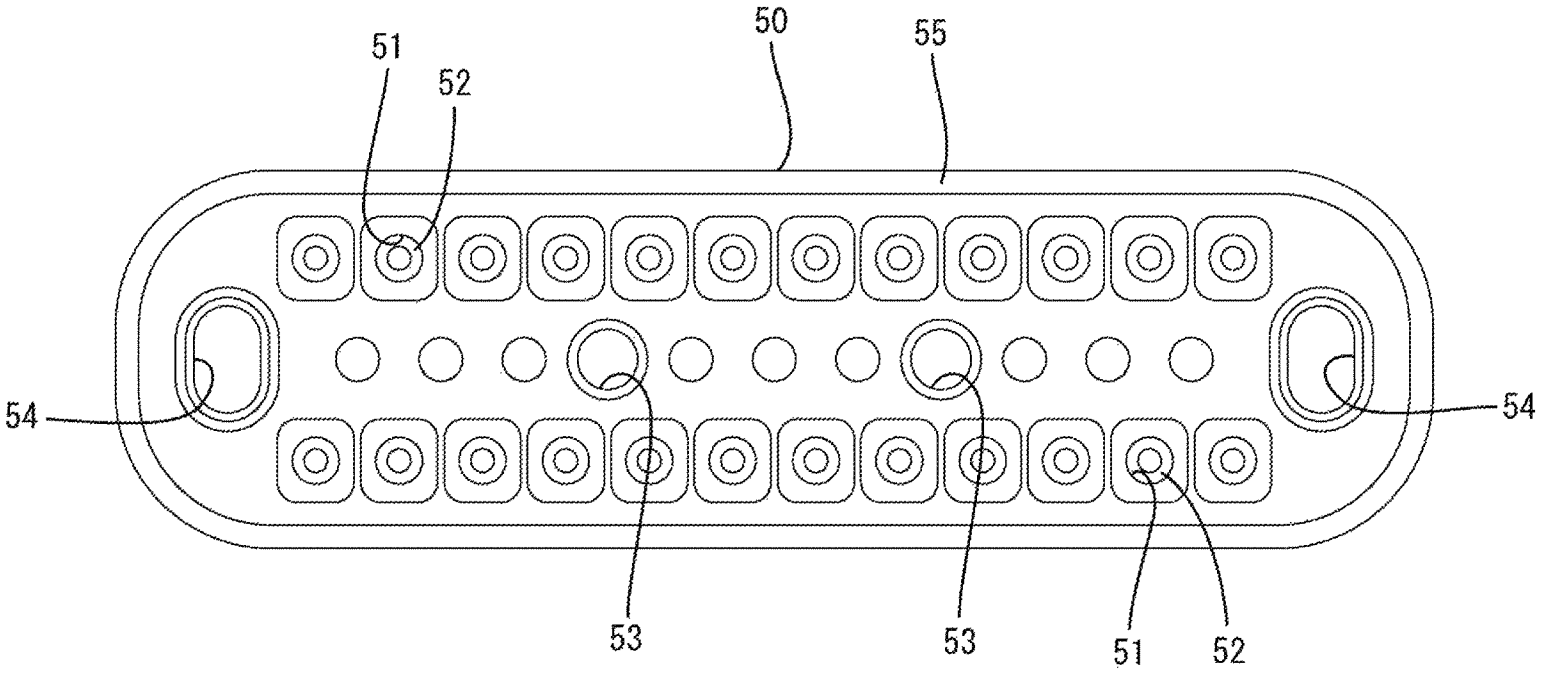
FIG. 5 is a front view of a one-piece rubber plug.

As shown in FIG. 5, the one-piece rubber plug 50 is in the form of a flat mat long in the lateral direction to correspond to the housing 70 and internally includes a plurality of seal holes 51 through which the wires 80 connected to the terminal fittings 90 are insertable. The respective seal holes 51 have a circular opening and are arranged in two upper and lower stages to correspond to the respective cavities 71. Inner peripheral lips 52 capable of being held in close contact with the outer peripheral surface of the wire 80 are circumferentially provided on the inner periphery of the seal hole 51.

Figure 2:
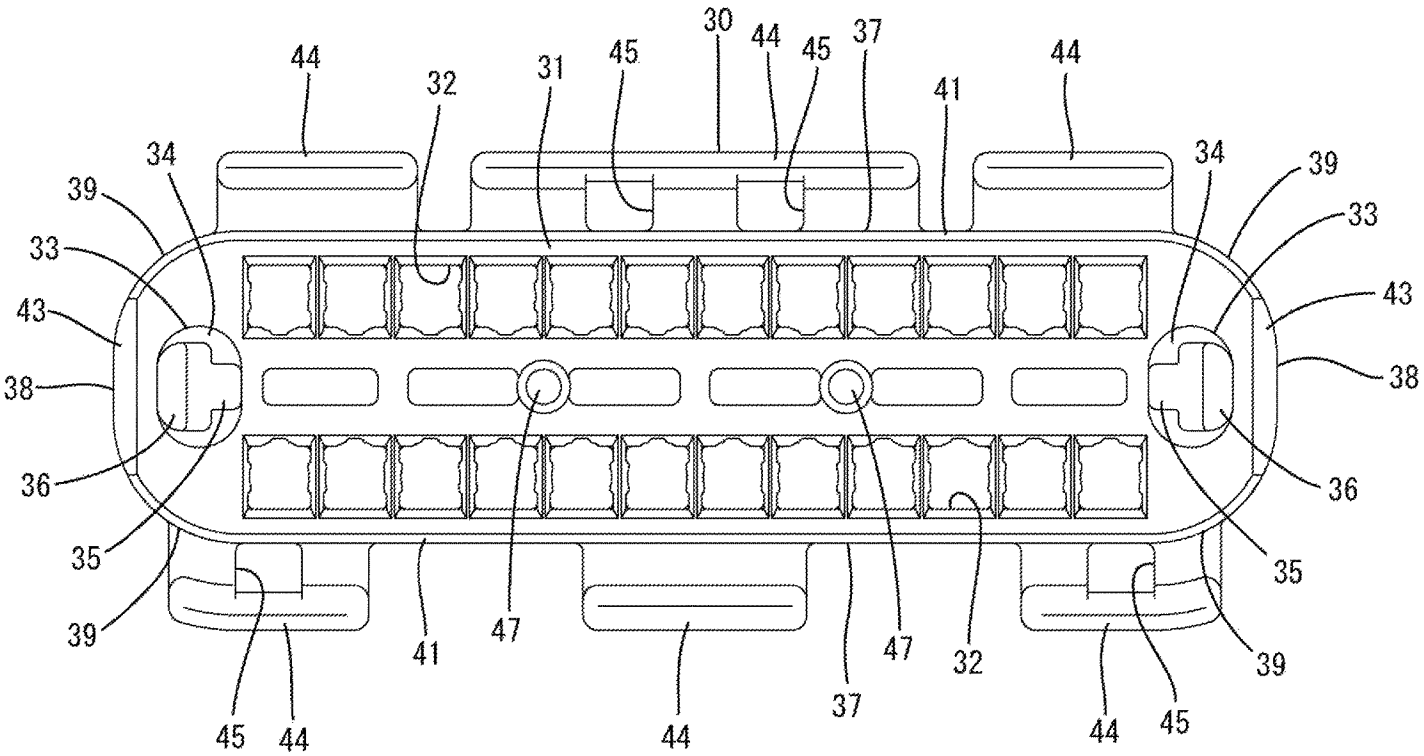
FIG. 2 is a front view of a rear holder.
Figure 3:
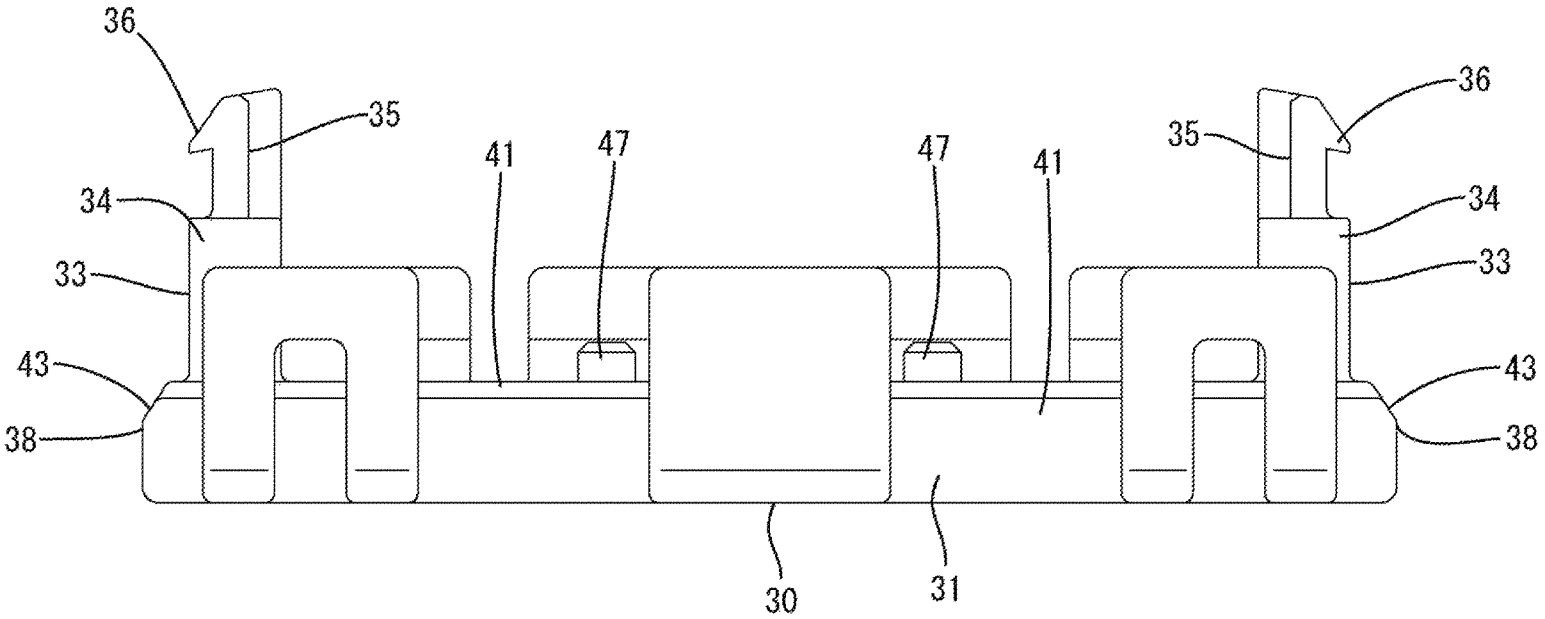
FIG. 3 is a bottom view of the rear holder.

Bottomed positioning holes 53 are provided side by side in the lateral direction between the upper and lower seal holes 51 on the front and rear surfaces of the one-piece rubber plug 50. Positioning pins 47 provided on the housing 70 and the rear holder 30 (only positioning pins 47 provided on the rear holder are shown in FIGS. 2 and 3) are fitted into the respective positioning holes 53, whereby the one-piece rubber plug 50 is positioned with respect to the housing 70 and the rear holder 30. Through holes 54 are provided on opposite left and right end parts of the one-piece rubber plug 50 across an area where the seal holes 51 are arranged. The through holes 54 have an elliptical opening slightly longer in the vertical direction.

A plurality of lips 55 are provided one after another on the outer periphery of the one-piece rubber plug 50. Each lip 50 is provided over the entire circumference in a circumferential direction of the one-piece rubber plug 50 while having a constant projecting dimension. When the receptacle 10 is externally fitted to the housing 70, each lip 55 is held in close contact with a rear end part (opening end part) of the receptacle 10 and a clearance between the receptacle 10 and the one-piece rubber plug 50 is sealed in a liquid-tight manner.

As shown in FIG. 2, the rear holder 30 includes a holder main body 31 corresponding to the housing 70 and in the form of a flat plate short in the vertical direction and long in the lateral direction when viewed from front. A plurality of wire insertion holes 32 through which the wires 80 are to be loosely inserted after the insertion of the terminal fittings 90 are provided to penetrate through the holder main body 31 in the front-back direction. The respective wire insertion holes 32 have a substantially rectangular cross-sectional shape corresponding to that of the connecting portions 91 of the terminal fittings 90 and are arranged in two upper and lower stages to correspond to the respective cavities 71 and the respective seal holes 51.

Figure 7:
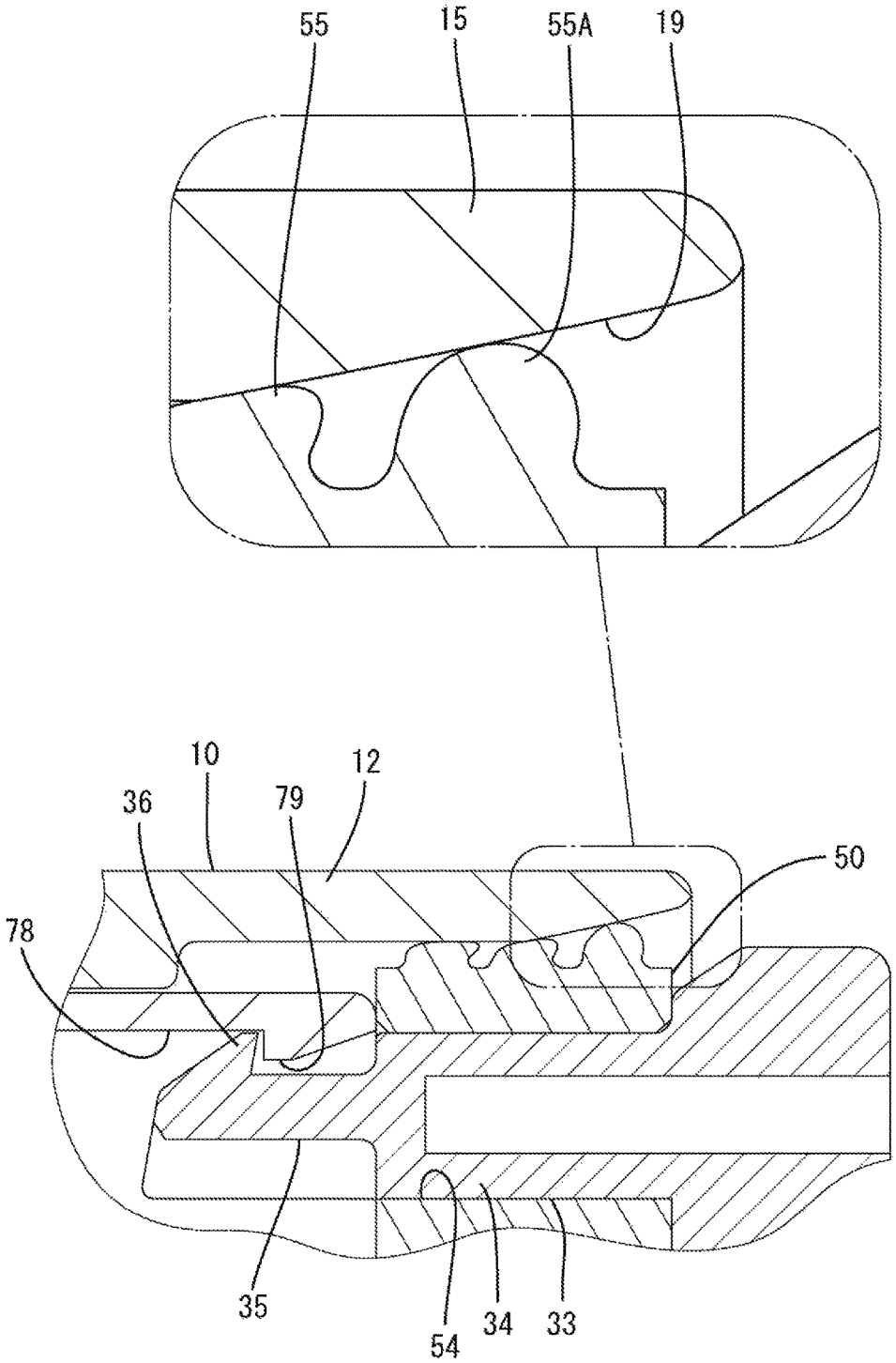
FIG. 7 is an enlarged view of an essential part while the receptacle is being externally fitted to a housing.

The positioning pins 47 insertable into the positioning holes 53 open on the rear surface of the one-piece rubber plug 50 project side by side in the lateral direction on the front surface of the holder main body 31. Lock pieces 33 are provided to project forward on opposite left and right end parts of the front surface of the holder main body 31 across an area where the respective wire insertion holes 32 are arranged. As shown in FIG. 3, the lock piece 33 is composed of a column-like base end portion 34 having an elliptical cross-sectional shape corresponding to the through hole 54 of the one-piece rubber plug 50 and a lock main body portion 35 projecting forward from the tip surface of the base end portion 34 and one size smaller than the base end portion 34. The base end portion 34 is held in close contact with the inner periphery of the through hole 54 and penetrates through the one-piece rubber plug 50 in a liquid-tight manner. The lock main body portion 35 is deflectable and deformable with a coupled part to the base end portion 34 as a supporting point. A claw-like locking projection 36 is provided to project outwardly on a tip part of the lock main body portion 35. As shown in FIG. 7, the lock main body portion 35 is inserted into a locking hole 78 open on the rear end surface of the housing 70 and the locking projection 36 is resiliently locked to a lock receiving portion 79 formed on the inner surface of the locking hole 78, whereby the rear holder 30 is held on the housing 70.

As shown in FIG. 2, both vertical end parts of the holder main body 31 include long surface portions 37 extending long straight in the lateral direction when viewed from front and both left and right end parts of the holder main body 31 include short surface portions 38 extending short straight in the vertical direction when viewed from front. Four corner parts of the holder main body 31 include corner surface portions 39 connecting both left and right ends of the long surface portions 37 and both upper and lower ends of the short surface portions 38 and arcuate when viewed from front. A holder-side chamfered portion 41 in the form of a cut is provided on the front end edge of each of the long surface portions 37 and the corner surface portions 39. As shown in FIG. 1, the holder-side chamfered portion 41 has a tapered shape inclined at a fixed angle toward the front.

Figure 8:
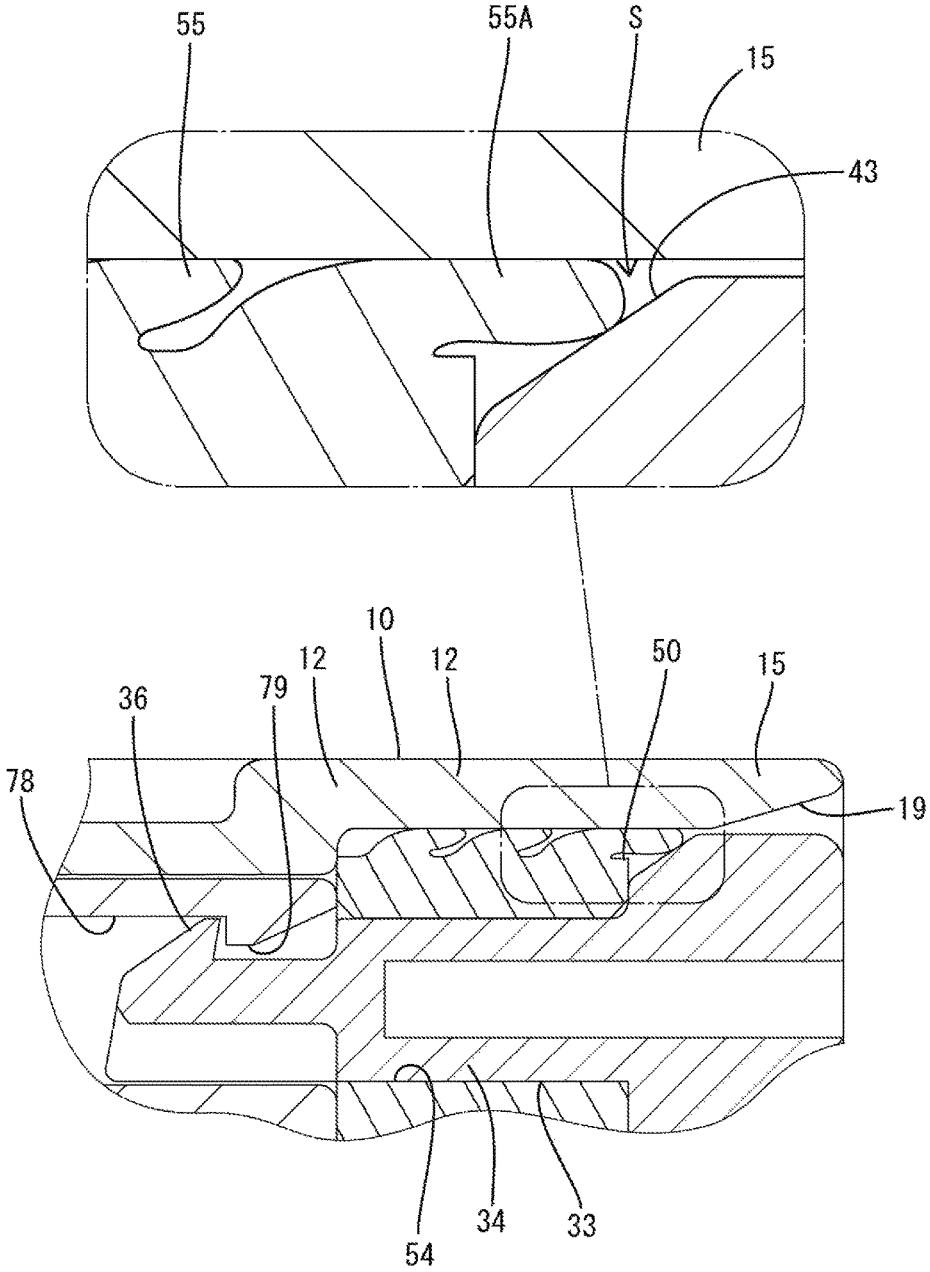
FIG. 8 is an enlarged view of an essential part in a state where the receptacle is externally fitted to the housing.

A holder-side escaping portion 43 in the form of a cut is provided on the front end edge of the short surface portion 38 of the holder main body 31. As shown in FIG. 8, the holder-side escaping portion 43 has a tapered shape inclined at a fixed angle toward the front. As shown in FIG. 3, angles of inclination of the holder-side escaping portions 43 and the holder-side chamfered portions 41 to the front-back direction are substantially equal. The holder-side escaping portions 43 have a longer length in the front-back direction than the holder-side chamfered portions 41, and the rear end edges of the holder-side escaping portions 43 are located behind those of the holder-side chamfered portions 41. Both upper and lower ends of the holder-side escaping portion 43 are included in the corner surface portions 39 and arranged to be connected to the holder-side chamfered portions 41.

Figure 4:
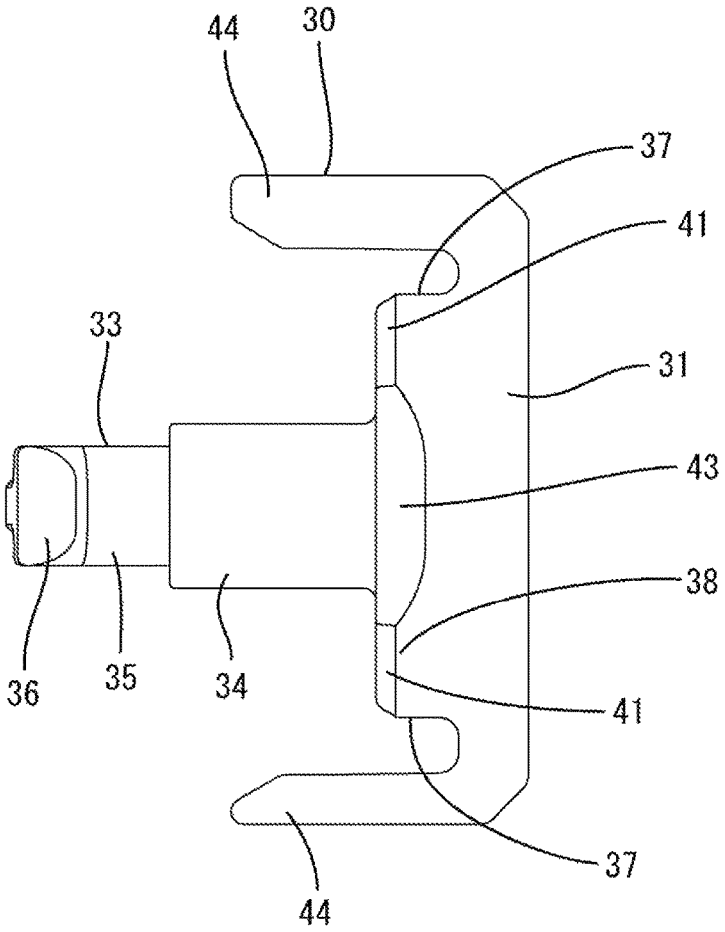
FIG. 4 is a side view of the rear holder.

As shown in FIG. 2, the front end edge of the holder-side escaping portion 43 extends straight in the vertical direction on the front surface of the holder main body 31. Further, as shown in FIG. 4, a vertical central part of the rear end edge of the holder-side escaping portion 43 extends straight in the vertical direction and both upper and lower end parts thereof arcuately extend from the vertical central part toward the holder-side chamfered portions 41.

A plurality of holding pieces 44 project side by side in the lateral direction on the upper and lower long surface portions 37 of the holder main body 31. Each holding piece 44 is in the form of a plate piece, projects forward after standing up and is arranged above the holder-side chamfered portion 41. Out of the holding pieces 44, those located on both left and right sides of the lower long surface portion 37 and the one located on a lateral center of the upper long surface portion 37 are provided with vertically penetrating holding holes 45 as shown in FIG. 1.

Figure 6:
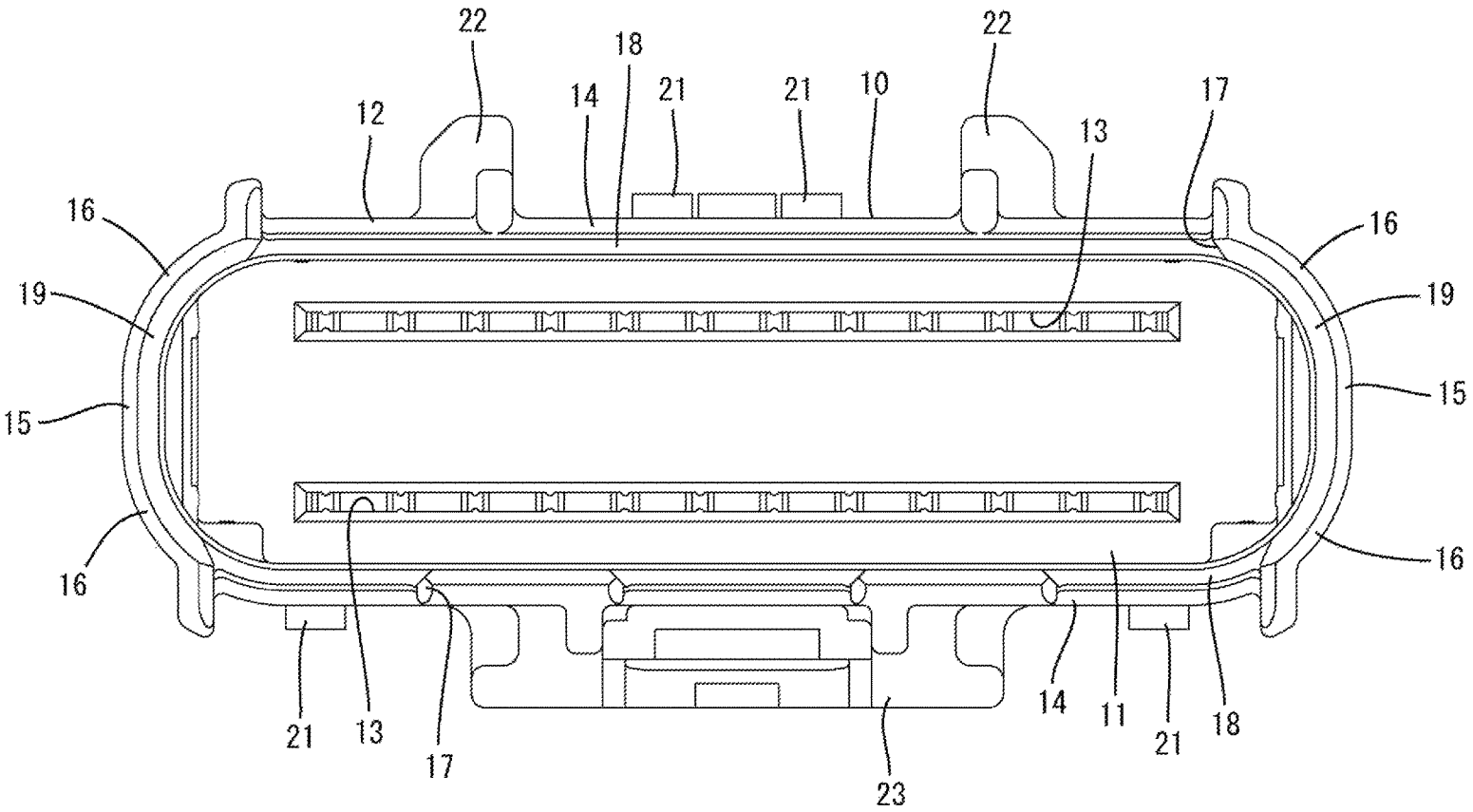
FIG. 6 is a rear view of a receptacle.

Next, the receptacle 10 is described. The receptacle 10 is in the form of a flat tube long in the lateral direction to correspond to the housing 70 and includes, as shown in FIGS. 1 and 6, a back wall portion 11 and a peripheral wall portion 12 projecting backward from the outer peripheral edge of the back wall portion 11. Press-fit holes 13 into which the busbars 100 are to be mounted by press-fitting are provided in two upper and lower stages on the back wall portion 11. The busbar 100 includes the tab piece 110 projecting into the receptacle 10 and connectable to the corresponding terminal fitting 90.

As shown in FIG. 6, both upper and lower end walls of the peripheral wall portion 12 include long side walls 14 extending long straight in the lateral direction when viewed from behind and both left and right end walls of the peripheral wall portion 12 include short side walls 15 extending short straight in the vertical direction when viewed from behind. Four corner parts of the peripheral wall portion 12 include corner walls 16 connecting both left and right ends of the long side walls 14 and both upper and lower ends of the short side walls 15 and arcuate when viewed from behind. Cut portions 17 recessed forward from the rear end edges of the short side walls 15 and the corner walls 16 are provided on the rear end edges (opening end edges) of the long side walls 14. When the receptacle 10 is externally fitted to the housing 70, standing-up parts of the holding pieces 44 are inserted into the cut portions 17.

A receptacle-side chamfered portion 18 in the form of a cut is provided on the inner surface of a rear end part of the long side wall 14. The receptacle-side chamfered portion 18 has a tapered shape opening at a fixed angle toward the back. Further, a receptacle-side escaping portion 19 in the form of a cut is provided on the inner surfaces of rear end parts of the short side wall 15 and the corner walls 16. The receptacle-side escaping portion 19 has a tapered shape opening at a fixed angle toward the back. An angle of inclination of the receptacle-side escaping portions 19 to the front-back direction is smaller than that of the receptacle-side chamfered portions 18 to the front-back direction. The receptacle-side escaping portions 19 have a longer length in the front-back direction than the receptacle-side chamfered portions 18. The rear end edges of the receptacle-side escaping portions 19 are located behind those of the receptacle-side chamfered portions 18 (except the receptacle-side chamfered portions 18 on the side of the cut portions 17).

Claw-like holding projections 21 are provided at positions behind the receptacle-side chamfered portions 18 on the outer surfaces of the long side walls 14. As shown in FIG. 1, the receptacle 10 is externally fitted to the housing 70 and the holding projections 21 are resiliently inserted into the holding holes 45 of the holding pieces 44, whereby the receptacle 10 is held on the housing 70 via the rear holder 30. As shown in FIG. 6, a pair of holding projections 21 are arranged in each of a lateral central part of the upper long side wall 14 and on both left and right sides of the lower long side wall 14. Rail-like guide portions 22 extending in the front-back direction are provided at opposite left and right sides across the holding projections 21 on the outer surface of the upper long side wall 14. Further, a mounting portion 23 in the form of a flat box is provided between the both left and right holding projections 21 on the outer surface of the lower short side wall 14. The guide portions 22 and the mounting portion 23 are mounted by being engaged with an unillustrated bracket mounting structure.

Next, how to assemble the connector is described.

First, the one-piece rubber plug 50 is mounted on the housing 70 from behind. At this time, the one-piece rubber plug 50 is positioned with respect to the housing 70 by inserting unillustrated positioning pins of the housing 70 into the positioning holes 53 of the one-piece rubber plug 50, whereby the respective seal holes 51 of the one-piece rubber plug 50 communicate with the respective cavities 71 of the housing 70.

Subsequently, the rear holder 30 is mounted to the housing 70 from behind to cover the rear surface of the one-piece rubber plug 50. The lock main body portions 35 of the lock pieces 33 are inserted into the locking holes 78 of the housing 70 through the through holes 54 of the one-piece rubber plug 50 and the locking projections 36 of the lock main body portions 35 are locked to the lock receiving portions 79, whereby the rear holder 30 is held on the housing 70. At this time, the front surface of the holder main body 31 is in close contact with the rear surface of the one-piece rubber plug 50 and the positioning pins 47 of the rear holder 30 are inserted into the positioning holes 53 of the one-piece rubber plug 50, whereby the one-piece rubber plug 50 is positioned with respect to the rear holder 30 and sandwiched and held between the rear holder 30 and the housing 70. Further, the respective seal holes 51 of the one-piece rubber plug 50 communicate with the respective wire insertion holes 32 of the rear holder 30. Furthermore, the base end portions 34 of the lock pieces 33 are inserted into the through holes 54 and the both left and right ends of the one-piece rubber plug 50 are pressed against the base end portions 34 and deformed to bulge outwardly. In this way, the interior of the connector is held in a liquid-tight manner.

Subsequently, the terminal fitting 90 is inserted into each cavity 71 of the housing 70. The terminal fitting 90 is inserted into the cavity 71 from the wire insertion hole 32 by way of the seal hole 51. When the terminal fitting 90 is inserted into the cavity 71, the outer peripheral surface of the wire 80 is resiliently held in close contact with the inner peripheral lips 52 of the seal hole 51 and the one-piece rubber plug 50 is deformed to bulge slightly outwardly.

Subsequently, the receptacle 10 is externally fitted to the housing 70 from front. In the process of externally fitting the receptacle 10, the inner surface of the rear end part of the receptacle 10 slides on the lips 55 of the one-piece rubber plug 50 and the lips 55 are dragged by the receptacle 10 to tilt backward. At this time, on the long sides, the lips 55 slide on the receptacle-side chamfered portions 18 of the long side walls 14 and the long side walls 14 can resiliently bulge outwardly utilizing their lateral lengths. Thus, sliding resistance between the lips 55 and the long side walls 14 is reduced and the tilt (inclination) of the lips 55 is also suppressed to be small. Further, on the short sides, the lips 55 slide on the receptacle-side escaping portions 19 of the short side walls 15 as shown in FIG. 7, but the receptacle-side escaping portions 19 are retracted outward in directions away from the lips 55. Thus, as on the long sides, sliding resistance between the lips 55 and the short side walls 15 is reduced and the tilt of the lips 55 is also suppressed to be small. Therefore, the lips 55 do not largely tilt backward in the process of externally fitting the receptacle 10.

When the receptacle 10 is externally fitted to the housing 70, the receptacle-side escaping portions 19 and the receptacle-side chamfered portions 18 pass over the one-piece rubber plug 50 to be separated therefrom, the long surface portions 37 of the rear holder 30 are arranged to face the inner sides of the rear end parts of the long side walls 14 and the short surface portions 38 of the rear holder 30 are arranged to face the inner sides of the rear end parts of the short side walls 15. In this state, the respective holding projections 21 of the receptacle 10 are inserted and locked to the holding holes 45 of the respective holding pieces 44 of the rear holder 30 and the receptacle 10 is retained and held on the housing 70 via the rear holder 30.

As described above, the backward tilt of the lips 55 can be suppressed by the deflection of the long side walls 14 and escaping structures of the receptacle-side escaping portions 19, but the lips 55 are dragged by the rear end part of the receptacle 10 to tilt backward in any way. In the case of this embodiment, the holder-side escaping portions 43 of the rear holder 30 are located to be retracted from the lips 55 behind the lips 55 on the short sides that tend to largely tilt and the holder-side chamfered portions 41 are located also behind the lips 55 on the long sides that are expected to tilt to a relatively small degree. Thus, the tilt of the lips 55 is permitted.

Specifically, as shown in FIG. 8, the last lip 55A is accommodated in a tilted state in a space S between the holder-side escaping portion 43 (also holder-side chamfered portion 41) of the rear holder 30 and the inner surface of the receptacle 10. Further, the last lip 55A is in contact along the tapered inclined surface of the holder-side escaping portion 43 and can be held in close contact with the inner surface of the rear end part of the receptacle 10 with a predetermined resilient force by receiving a reaction force from the rear holder 30. Thus, a clearance between the receptacle 10 and the one-piece rubber plug 50 is filled up with all the lips 55 including the last lip 55A and the sealability of the one-piece rubber plug 50 is satisfactorily ensured.

On the other hand, since the last lip 55A is not strongly pushed back by the rear holder 30 due to the holder-side escaping portions 43 and the escaping structures of the holder-side chamfered portions 41, the last lip 55A is not likely to be caught between the inner surface of the receptacle 10 and the rear holder 30 and the damage of the lips 55 can be prevented.

As described above, according to this embodiment, the tilt of the lips 55 can be suppressed to be small in the process of externally fitting the receptacle 10 to the housing 70 since the receptacle-side escaping portions 19 are retracted in the directions to reduce the contact with the lips 55 on the short sides. Further, the tilt of the lips 55 on the long sides can be suppressed to be small by the deflection of the long side walls 14. Thus, the tilt of the lips 55 can be suppressed to be small on both short and long sides.

Further, when the receptacle 10 is externally fitted to the housing 70, the tilt of the lips 55 is permitted by the holder-side escaping portions 43 and the holder-side chamfered portions 41 and the tilted lips 55 are not strongly pushed back by the rear holder 30. Thus, a situation where the lips 55 are caught between the receptacle 10 and the rear holder 30 can be avoided. As a result, the damage of the lips 55 can be prevented and the sealability of the one-piece rubber plug 50 is satisfactorily ensured.

Further, since the receptacle-side chamfered portions 18 need not have a largely retracted shape unlike the receptacle-side escaping portions 19, the enlargement of the receptacle 10 can be avoided. Further, since the holder-side escaping portions 43 are tapered and inclined backward and the lips 55 can be inclined along the holder-side escaping portions 43, the damage of the lips 55 can be more reliably prevented.

Furthermore, since the lock pieces 33 are arranged at the positions closer to the short surface portions 38 than to the long surface portions 37, a contact pressure between the receptacle 10 and the lips 55 may increase and the lips 55 on the short sides may easily tilt when the lock pieces 33 penetrate through the through holes 54 of the one-piece rubber plug 50 and the one-piece rubber plug 50 bulge outwardly. However, in the case of this embodiment, the lips 55 can escape toward the holder-side escaping portions 43 since the holder-side escaping portions 43 are provided on the short sides.

Furthermore, since the receptacle-side escaping portions 19 are arranged at the positions distant from the lips 55 and parts of the rear end part of the receptacle 10 other than the receptacle-side escaping portions 19 are held in close contact with the lips 55 with the receptacle 10 externally fitted to the housing 70, predetermined sealability can be reliably ensured by increasing a close contact force between the receptacle 10 and the lips 55.

Other embodiments are described briefly below.

Although the busbars are mounted in the receptacle in the above embodiment, male terminal fittings may be accommodated in the receptacle and further connected to end parts of wires in the present invention.

The receptacle may be a mere cap (see, for example, Japanese Unexamined Patent Publication No. 2006-127992 in the Background Art) holding no busbars.

In the present invention, contrary to the above embodiment, the short side walls and the short surface portions may be arranged along the lateral direction and the long side walls and the long surface portions may be arranged along the vertical direction. In short, when a short side direction of the short side walls and the short surface portions is a first direction, a long side direction of the long side walls and the long surface portions has only to be a second direction intersecting with the first direction.

Although the short side walls and the short surface portions extend straight when viewed from front in the above embodiment, the short side walls and the short surface portions may be arcuately curved when viewed from front in the present invention.

The rear end part of the housing may be structured to include an accommodation recess for accommodating the one-piece rubber plug.

The receptacle may be structured to be held on the housing by being locked to the housing.

The holder-side escaping portions may be provided in ranges including the short surface portions and the corner surface portions.

The receptacle-side escaping portions may be provided only on the short surface portions.

LIST OF REFERENCE SIGNS

10 . . . receptacle
14 . . . long side wall
15 . . . short side wall
19 . . . receptacle-side escaping portion
30 . . . rear holder
37 . . . long surface portion
38 . . . short surface portion
43 . . . holder-side escaping portion
50 . . . one-piece rubber plug
55 . . . lip

70 . . . housing
80 . . . wire
90 . . . terminal fitting

What is claimed is:

1. A watertight connector, comprising:

a housing into which terminal fittings are to be inserted, the housing having opposite front and rear ends;

a one-piece rubber plug arranged on a rear end part of the housing, the one-piece rubber plug including seal holes through which wires connected to the terminal fittings are to be inserted in a liquid-tight manner and including a lip on an outer periphery;

a rear holder arranged behind the one-piece rubber plug and configured to hold the one-piece rubber plug between the housing and the rear holder by being locked to the housing; and a receptacle to be fit externally to the housing from the front and having an opening end part to be held in close contact with the lip of the one-piece rubber plug, the receptacle including short side walls facing each other and extending in a first direction and long side walls facing each other and extending in a second direction intersecting the first direction, and receptacle-side escaping portions provided on inner peripheries of opening end parts of the short side walls along a part of the receptacle that overlies the one-piece rubber plug, the receptacle-side escaping portions being retracted away from the housing in directions transverse to the front-back direction farther than inner peripheries of opening end parts of the long side walls.

2. The watertight connector of claim 1, wherein the receptacle-side escaping portions are arranged at positions distant from the lip with the receptacle fit externally to the housing.

3. The watertight connector of claim 1, wherein the rear holder comprises a holder main body extending in a direction transverse to the front-back direction, short surface portions facing each other and extending forward from the holder main body in a first direction, and long surface portions extending forward from the holder main body in a second direction intersecting the first direction.

4. The watertight connector of claim 3, wherein holder-side escaping portions are formed on front ends of the short surface portions.

5. The watertight connector of claim 1, further comprising receptacle-side chamfered portions on inner surfaces of opening end parts of the long side walls.

6. The watertight connector of claim 5, wherein the chamfered portions contact the lip of the one-piece rubber plug when the receptacle is fit to the housing, and the long side walls are deflected away from the one-piece rubber plug.

7. The watertight connector of claim 5, wherein the receptacle-side escaping portions have a first angle of inclination, and the receptacle-side chamfered portions have a second angle of inclination, and the first angle of inclination is smaller than the second angle of inclination.

8. The watertight connector of claim 5, wherein the receptacle-side escaping portions have a first length in the front-back direction, and the receptacle-side chamfered portions have a second length in the front-back direction, and the first length is longer than the second length.

* * * * *